US006089877A

United States Patent [19]

Seidel

[11] Patent Number: 6,089,877

[45] Date of Patent: Jul. 18, 2000

[54] PLUG CONNECTOR

[75] Inventor: Peter Seidel, Groebenzell, Germany

[73] Assignee: Siemens Aktiengesellschaft, Munich, Germany

[21] Appl. No.: 09/105,952

[22] Filed: Jun. 26, 1998

[30] Foreign Application Priority Data

Jun. 26, 1997 [DE] Germany ..... 197 27 222

[51] Int. Cl.[7] ..... H01R 9/09

[52] U.S. Cl. ..... 439/79; 439/108

[58] Field of Search ..... 439/74, 79, 78, 439/947, 101, 108, 885, 660

[56] References Cited

U.S. PATENT DOCUMENTS

| | | | |
|---|---|---|---|
| 4,762,500 | 8/1988 | Dola et al. | 439/79 |
| 5,133,679 | 7/1992 | Fusselman et al. | 439/79 |
| 5,161,987 | 11/1992 | Sinisi | 439/101 |
| 5,174,764 | 12/1992 | Kandybowski et al. | 439/83 |
| 5,490,787 | 2/1996 | Bowman et al. | 439/79 |

FOREIGN PATENT DOCUMENTS

| | | |
|---|---|---|
| 0 546 505 A1 | 12/1992 | European Pat. Off. . |
| 86 05 187 U | 2/1986 | Germany . |

*Primary Examiner*—Renee S. Luebke
*Assistant Examiner*—T. C. Patel
*Attorney, Agent, or Firm*—Hill & Simpson

[57] ABSTRACT

A plug connector is disclosed for electrically connecting two printed boards consisting of a blade connector with a plurality of blade contacts arranged in a prescribed grid dimension and a spring clip adapted thereto with a plurality of spring contacts, whereby not only the blade contacts, but also the spring contacts are respectively connected to the printed boards via press-in pins arranged in the prescribed grid dimension. In the blade connector, to realize high-current contacts in the same grid dimension, one or more blade contacts are respectively allocated—via a blade body to press-in pins residing perpendicularly in a row, and in the spring clip one or more spring contacts are allocated-via a spring body—to press-in pins residing perpendicularly in a row, whereby the number of the spring contacts is equal to or greater than the number of blade contacts.

7 Claims, 5 Drawing Sheets

PLUG CONNECTOR

FIELD OF THE INVENTION

The present invention relates to a plug connector for electrically connecting two printed boards consisting of a blade connector with a plurality of blade contacts arranged in a prescribed grid dimension and a spring clip adapted thereto with a plurality of spring contacts, whereby not only the blade contacts, but also the spring contacts are respectively connected to the printed board via press-in pins arranged in the prescribed grid dimension.

BACKGROUND OF THE INVENTION

In such plug connectors with a prescribed grid dimension, e.g. according to IEC 1076-4-100, information signals are normally transmitted at each contact point—which respectively consists of a press-in pin of the blade connector, the blade contact, the spring contact and the press-in pin of the spring clip. This arrangement is used because, in the transmission of information signals, an optimally high number of transmission channels are required, and the information signals are low power signals. However, the previously mentioned plug connectors, such as the 2.5-millimeter grid dimension according to IEC 1076-4-100, are not suitable for a transmission of high current signals at each contact point because of high operating temperatures.

Therefore, there is a need for a plug connector for connecting two circuit boards with a plurality of blade contacts that can be effectively used to transmit high amperage signals.

SUMMARY OF THE INVENTION

It is thus the object of the present invention to propose a plug connector of the abovementioned type in which high amperage signals can be transmitted per each point, given high operating temperatures, in which the contacts are constructed with the printed board by press-in technique, and in which the established grid dimension is maintained.

This object is achieved by the present invention which provides a plug connector of the abovementioned type in that one or more blade contacts in the blade connector are respectively allocated—via a blade body—to press-in pins residing perpendicularly in a row, and that in the spring clip, one or more spring contacts are respectively allocated—via a spring body—to press-in pins residing perpendicularly in a row, whereby the number of the spring contacts is equal to or greater than the number of the blade contacts.

In the inventive plug connector, it is possible to allocate a plurality of press-in pins to a single blade contact point per printed board—e.g. five at the most—so that a transmission of high currents at a high operating temperature is enabled. In an embodiment, a single blade contact can be allocated to all the press-in pins of a blade connector—these pins residing in a perpendicular row—while at the same time a single spring contact is correspondingly allocated to all the press-in pins of a spring clip—these pins residing in a perpendicular row. But it is also possible in this special case to allocate five spring contacts to the press-in pins of the spring clip—these pins residing in a perpendicular row.

An appropriate development of the inventive plug connector is characterized in that two blade contacts are constructed per blade body which respectively form a Faston blade and which are of different widths for accepting different receptacles (Faston springs), and that each spring clip body is split into two spring contacts whose width correspond to the respective blade contacts.

Through the creation of Faston blades, high currents can be directly fed to a printed board via corresponding Faston springs.

In an embodiment, the present invention provides a plug connector for an electrical connection of two printed circuit boards. The plug connector comprises a blade connector comprising a number of blade contacts, the blade contacts being connected to a plurality of blade contact press-pins that extend perpendicular to the blade contacts. The blade contact press-pins are connected to one of the two circuit boards. The plug connector further comprises a spring clip comprising a number of spring contacts. The spring contacts being connected to a plurality of spring contact press-pins that are disposed perpendicular to the spring contacts. The spring contact press-pins are connected to the other of the circuit boards. The number of spring contacts is equal to or greater than the number of blade contacts.

In an embodiment, the blade contacts comprise a first blade contact and a second blade contact. The first blade contact being wider than the second blade contact. The spring contacts further comprise a first spring contact and a second spring contact. The width of the first spring contact being sized to frictionally and matably receive the first blade contact and the width of the second spring contact being sized to frictionally and matably receive the second blade contact.

In an embodiment, the plug connector further comprises a spring body that extends from the spring contacts to the spring contact press-pins and connects the spring contacts to the spring contact press-pins.

In an embodiment, the plug connector of the present invention further comprises a blade body that extends from the blade contacts to the blade contact press-pins and connects the blade contacts to the blade contact press-pins.

In an embodiment, the spring body is punched out from a single piece of sheet metal and subsequently bent to dispose the spring contacts and spring contact press-pins at right angles with respect to each other.

In an embodiment, the first and second blade contacts form a Faston blade.

In an embodiment, the first and second spring contacts form Faston springs.

Other objects and advantages of the invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of an example of the invention.

In the drawings.

Figure 1:
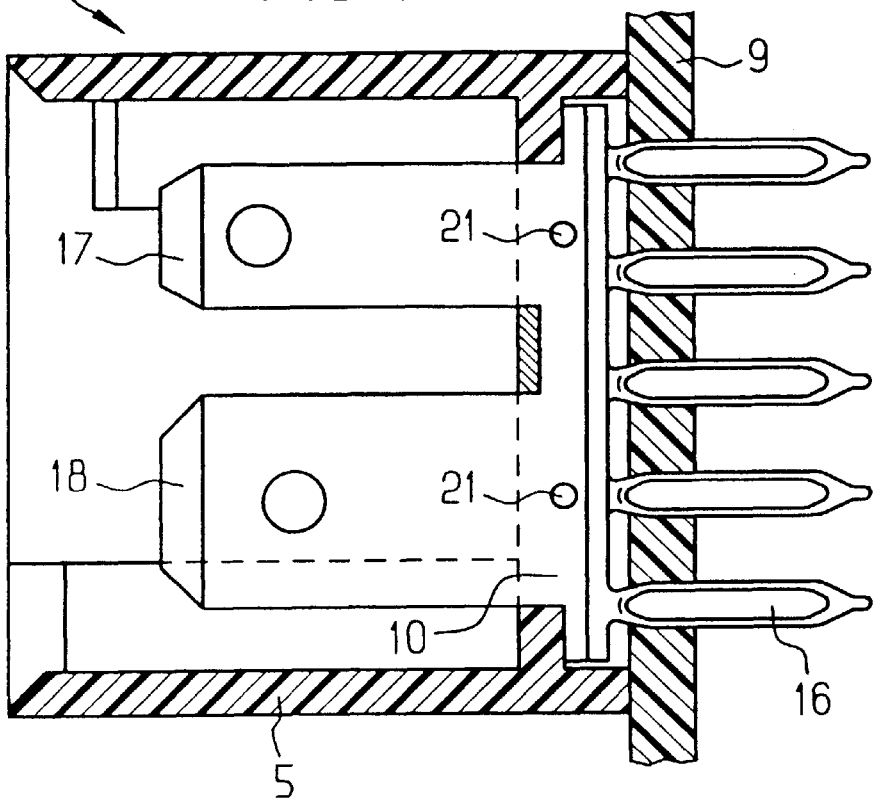
FIG. 1 is a cross-sectional view of a blade connector in a first embodiment of the present invention.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

In the inventive plug connector, the blade connectors as well as the spring clips can be constructed not only as 900 embodiments (see FIGS. 3–4 and 8–10) but also as 180° embodiments (see FIGS. 1–2 and 5–7). In the 180° embodiment therein, the press-in pins form an angle of 180° with respect to the blade, or respectively, the spring contacts, while in the 90° embodiment, the press-in pins are bent 90° with respect to the blade, or respectively, the spring contacts.

The blade connectors 1 and 2 essentially consist of the centering clips 5 and 6 as well as the blade bodies 10 and 11 with the corresponding blade contacts 17 and 18 as well as the press-in pins 16 via which the contacting with a printed board 9 occurs. The blade bodies 10 and 11 are held in the centering clips 5 and 6 by means of protrusions or "warts" 21 constructed on the blade bodies 10 and 11. A detailed description of the blade connectors is forgone in this context, since this is not principal to the invention and is known to those skilled in the art.

The blade connectors depicted in FIGS. 1 to 4 possess two blade contacts 17 and 18, respectively, which are constructed as Faston blades. The narrow blade contact 17 therein possesses a standardized plug width of 2.8 mm, while the wide blade contact 18 comprises a standardized width of 4.8 mm. These Faston blades are utilized when a high current is fed to a printed board directly via an external flexible cable with a corresponding receptacle, i.e., a Faston spring. It is simultaneously possible to contact these Faston blades with corresponding spring contacts of a spring clip, however, as will be explained later.

The known press-in technique is not discussed in detail here, either, as this is generally known. In this context, it is merely established that the blade connectors, or respectively, spring clips can be mechanically secured to the printed board 9 via press-in journals 22. In the cases in which such a securing is not sufficient, it is of course also possible to bolt the blade connectors, or respectively, spring clips to the printed boards.

Figure 2:
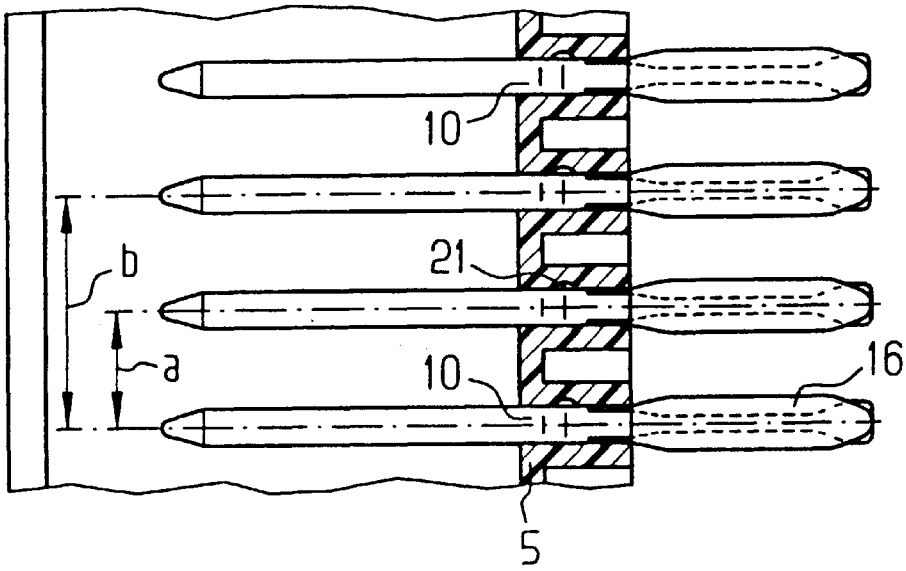
FIG. 2 is a partial longitudinal sectional view of the blade connector shown in FIG. 1.
Figure 3:
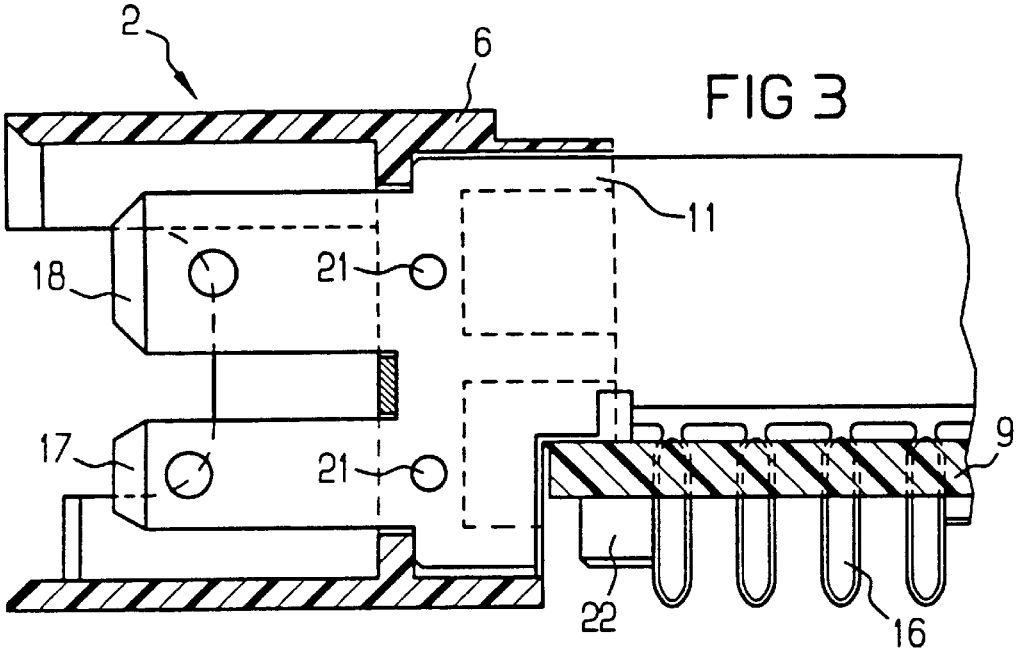
FIG. 3 is a partial cross-sectional view of a blade connector in a second embodiment of the present invention.
Figure 4:
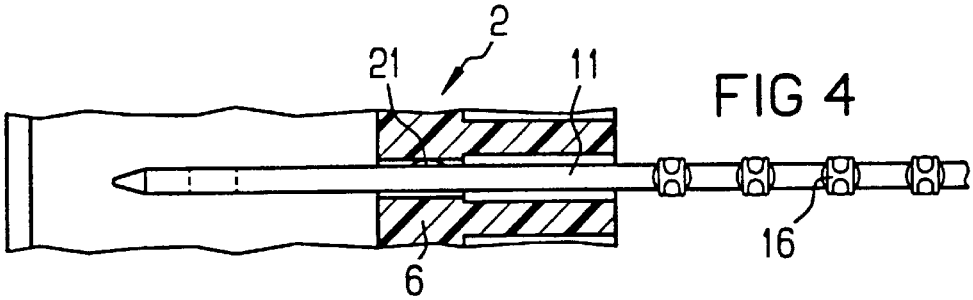
FIG. 4 is a partial longitudinal sectional view of the blade connector shown in FIG. 3.
Figure 12:
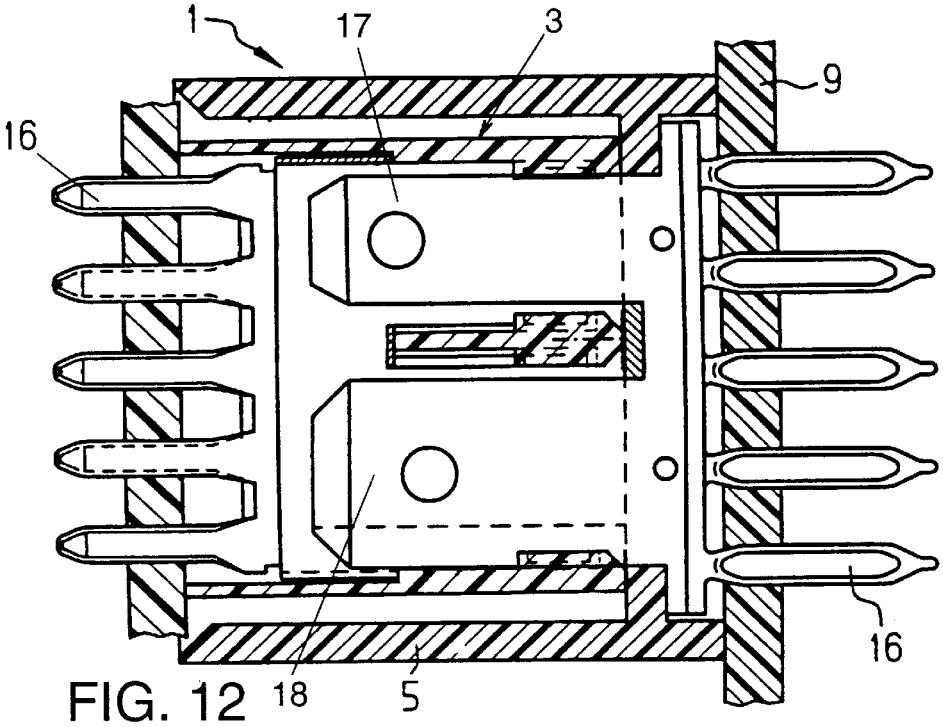
FIG. 12 is an assembly of blade and spring clip connectors.
Figure 5:
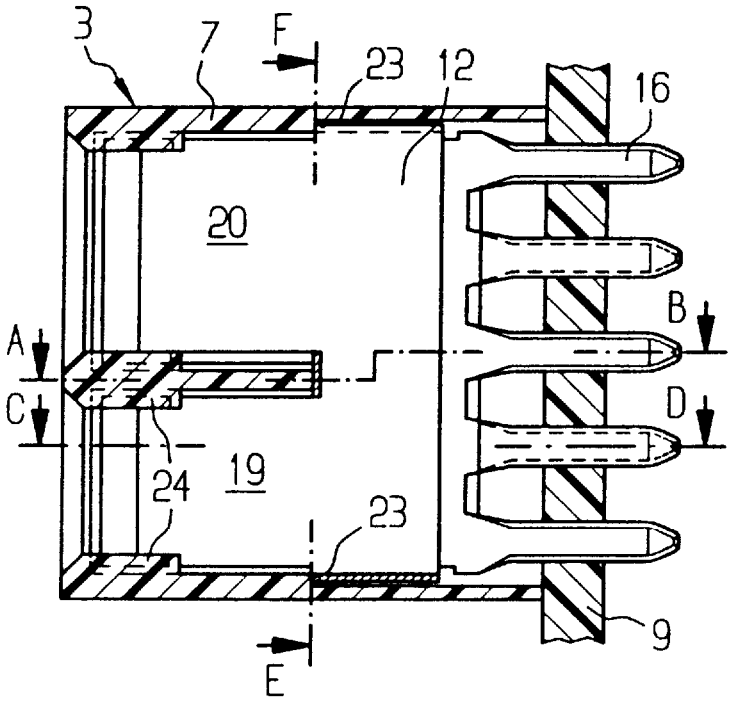
FIG. 5 is a cross-sectional view of a spring clip in a third embodiment of the present invention.
Figure 6:
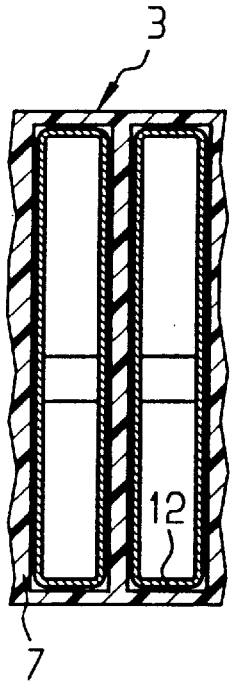
FIG. 6 is a sectional view taken substantially along line E-F of FIG. 5.
Figure 7:
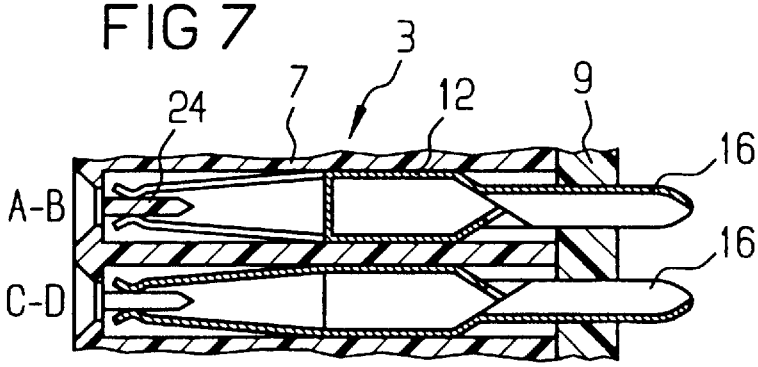
FIG. 7 is a sectional view taken substantially along lines A-B and C-D of FIG. 5.
Figure 8:
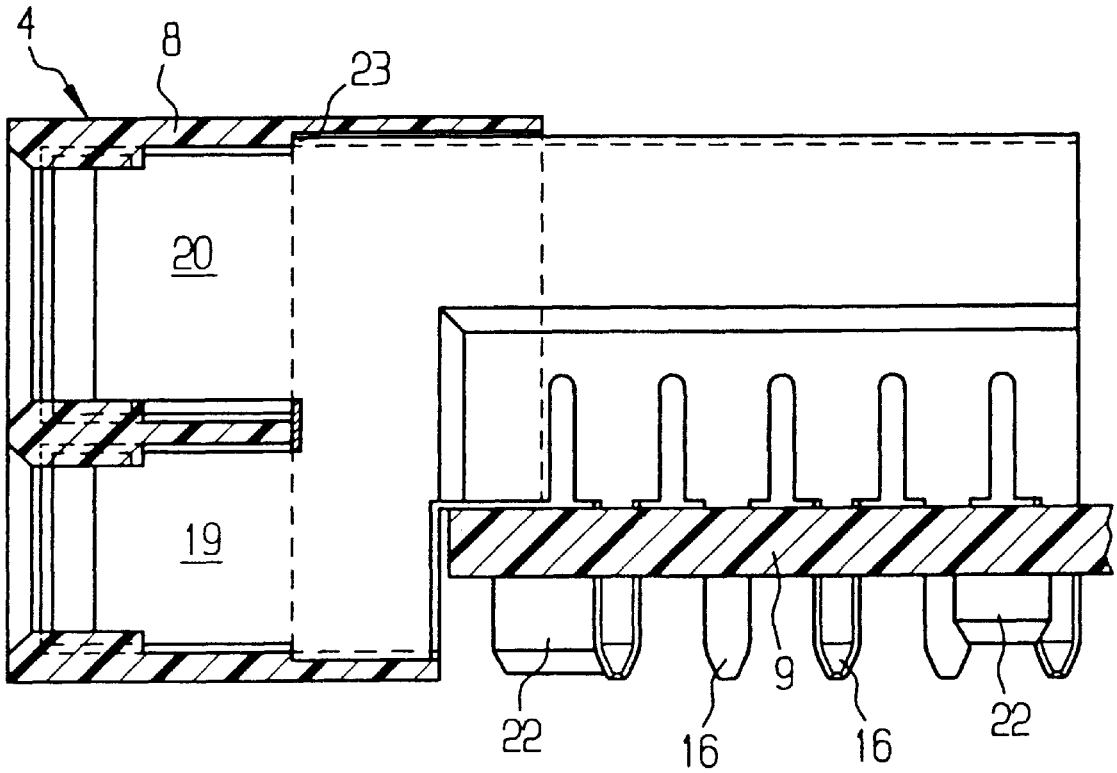
FIG. 8 is a cross-sectional view of fourth embodiment of the present invention.
Figure 9:
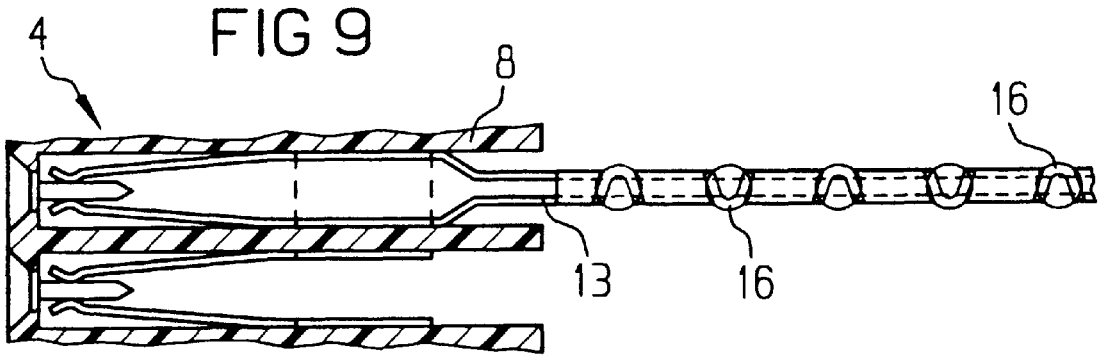
FIG. 9 is a partial longitudinal sectional view of the spring clip shown in FIG. 8.

In FIG. 2, it is indicated that the corresponding blade contacts and also the corresponding spring contacts, and accordingly, can be provided at the normal grid element spacing "a". Beyond this, the possibility also exists of arranging the high-current contact points at spacings which equal a whole-number multiple of the basic grid dimension of, e.g., 2.5 mm. This distance can be selected corresponding to the voltages utilized and the appertaining air gaps and creep distances.

The spring clips 3 and 4 essentially consist of the spring clip bodies 7 and 8 as well as the spring bodies 12 and 13 with the spring contacts 19 and 20 as well as the press-in pins 16. The spring clip bodies 7, or respectively, 8 possess spring supports 23 for supporting the spring during the press-in process. Ribs 24 are provided in the insertion region which serve the pre-opening of the spring contacts. The standardized construction of a spring clip is not discussed in this context, as this is known to those skilled in the art.

The spring clips 3 and 4 depicted in FIGS. 5 to 9 are adapted to the blade connector 1 shown in FIGS. 1 and 2. It should be established in this context, however, that the invention permits many variations of the allocation of blade contacts and spring contacts to the press-in pins. In a plug connector according to the abovementioned type, five press-in pins are arranged in a perpendicular row, for example. It would be possible to allocate one blade contact to the five press-in pins of a blade connector, respectively, and to likewise allocate one spring contact to the five press-in pins of a spring clip. But it would also be possible to allocate—on the side of the spring clip—five spring contacts which are connected to five press-in pins via the corresponding spring body to a blade contact which is allocated to five press-in pins of the blade connector. Arbitrary combinations can be selected here according to the requirements.

Figure 10:
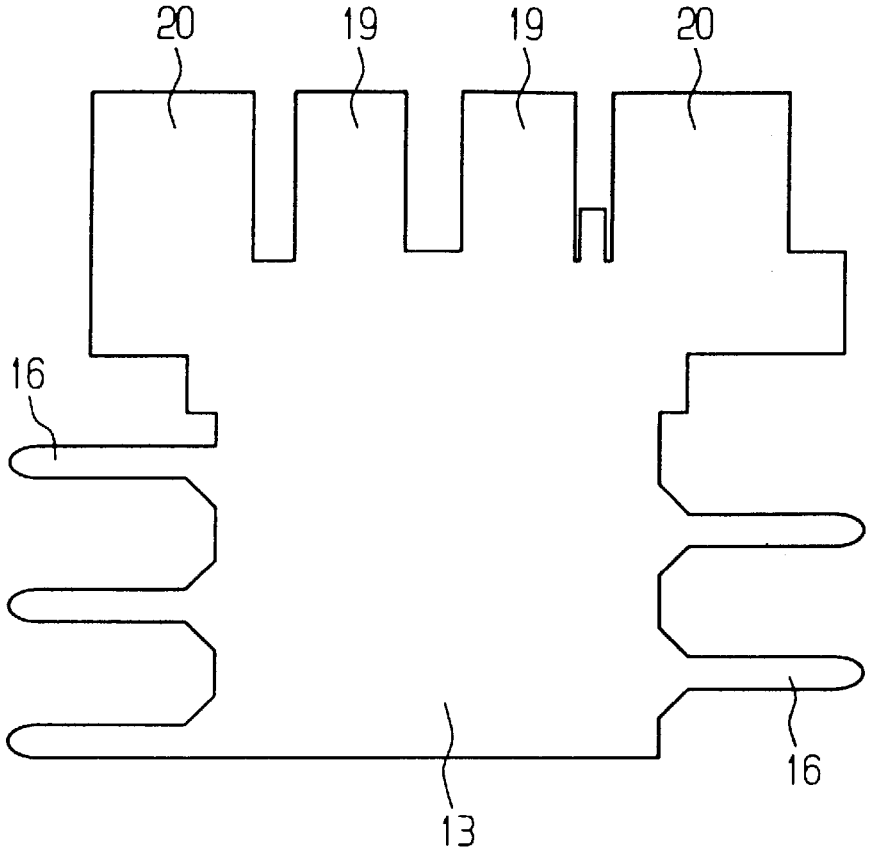
FIG. 10 is a plan view of a blank of the spring clip body of the spring clip shown in FIG. 8.
Figure 11:
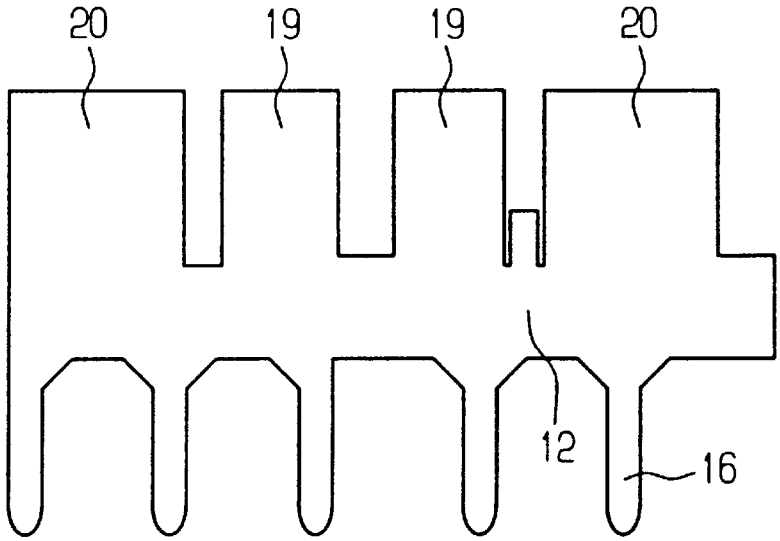
FIG. 11 is a plan view of a blank of the spring clip body of the spring clip shown in FIG. 5.

By way of conclusion, an appropriate method for producing the spring body with the appertaining spring contacts and press-in pins is additionally demonstrated. An appropriate method for producing such a spring body thus consists in punching it out of a flat sheet as flat piece, as depicted in FIGS. 10 and 11. After stamping, this piece of sheet is bent several times about an axis of symmetry so that the final form results wherein the press-in journals are respectively arranged in a row in a comb-like fashion. The bending of the flat spring clip body into its final form can be seen particularly in the comparison of FIGS. 11 and 6.

From the above description it is apparent that the objects of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed:

1. A plug connector for the electrical connection of two printed circuit boards, the plug connector comprising:

a blade connector comprising a blade body connected to a plurality of blade contacts, the blade body being connected to a plurality of blade contact press-pins that extend perpendicular to the blade body, the blade contact press-pins being connected to one of the circuit boards, the number of blades contact press-pins exceeding the number of blade contacts and a spring clip comprising a spring body connected to a plurality of of spring contacts, the spring body being connected to a plurality of spring contact press-pins that are disposed perpendicular to the spring body, the spring contact press-pins being connected to other of the circuit boards, the number of spring contact press-pins exceeding the number of spring contacts, the number of spring contacts being equal to or greater than the number of blade contacts, each blade contact being matably received in and electrically connected to one of the spring contacts.

2. The plug connector of claim 1 wherein the blade contacts comprise a first blade contact and a second blade contact, the first blade contact having a first width, the second blade contact having a second width, the first width being different from the second width, the spring contacts comprising a first spring contact and a second spring contact, the first spring contact having a width sized to frictionally and matably receive the first blade contact, the second spring contact having a width sized to frictionally and matably receive the second blade contact.

3. The plug connector of claim 1 further comprising a spring body that extends from the spring contacts to the spring contact press-pins and connects the spring contacts to the spring contact press-pins.

4. The plug connector of claim 3 wherein the spring body is punched out from a single sheet of metal and subsequently bent to dispose the spring contacts and spring contact press-pins in the perpendicular relationship with respect to each other.

5. The plug connector of claim 1 further comprising a blade body that extends from the blade contacts to the blade contact press-pins and connects the blade contacts to the blade contact press-pins.

6. A plug connector for the electrical connection of two printed circuit boards, the plug connector comprising:

a blade connector comprising a blade body connected to first and second blade contacts, the blade body being connected to at least three blade contact press-pins that extend perpendicular to the blade body, being the first blade contact having a first width, the second blade contact having a second width, the first being different from the second width, the blade contact press-pins being connected to one of the circuit boards, a spring clip comprising a spring body connected to first and second spring contacts, the spring body being connected to at least three spring contact press-pins that are disposed perpendicular to the spring body, the first spring contact having a width sized to frictionally and matably received the first blade contact, the second spring contact having a width sized to frictionally and matably receive the second blade contact, the spring contact press-pins being connected to other of the circuit boards.

7. The plug connector of claim 6 wherein the spring body is punched out from a single sheet of metal and subsequently bent to dispose the spring contacts and spring contact press-pins in the perpendicular relationship with respect to each other.

* * * * *